US005105788A

United States Patent [19]

Engel

[11] Patent Number: 5,105,788

[45] Date of Patent: Apr. 21, 1992

[54] FUEL INJECTION SYSTEM FOR AN INTERNAL-COMBUSTION ENGINE

[75] Inventor: Gerhard Engel, Stuttgart, Fed. Rep. of Germany

[73] Assignee: Robert Bosch GmbH, Stuttgart, Fed. Rep. of Germany

[21] Appl. No.: 719,782

[22] Filed: Jun. 24, 1991

[30] Foreign Application Priority Data

Jul. 10, 1990 [DE] Fed. Rep. of Germany ..... 4021886

[51] Int. Cl.[5] ..... F02D 41/26; F02P 5/14

[52] U.S. Cl. ..... 123/501; 123/419; 123/436; 123/414

[58] Field of Search ..... 123/500, 501, 419, 436, 123/494, 359, 479, 414, 476, 612

[56] References Cited

U.S. PATENT DOCUMENTS

| | | | |
|---|---|---|---|
| 4,197,767 | 4/1980 | Leung | 123/179 G |
| 4,357,662 | 11/1982 | Schira et al. | 123/419 |
| 4,485,784 | 12/1984 | Fujii et al. | 123/414 |
| 4,503,830 | 3/1985 | Nakamura et al. | 123/501 |
| 4,509,477 | 4/1985 | Takao et al. | 123/436 |
| 4,825,373 | 4/1989 | Nakamura et al. | 123/501 |
| 4,862,853 | 9/1989 | Tsukamoto et al. | 123/419 |
| 4,869,221 | 9/1989 | Abe | 123/414 |
| 4,926,822 | 5/1990 | Abe et al. | 123/414 |
| 4,953,531 | 9/1990 | Abe | 123/414 |
| 4,987,875 | 1/1991 | Hofer et al. | 123/419 |

*Primary Examiner*—E. Rollins Cross
*Assistant Examiner*—Thomas N. Moulis
*Attorney, Agent, or Firm*—Kenyon & Kenyon

[57] ABSTRACT

A fuel injection system, in which the injection quantity and the start of injection are controlled with solenoid valves, in view of engine-specific data and various parameters. Rotational-speed pulses are measured at the camshaft and/or at the crankshaft. Trigger times, which establish the start of injection and the injection quantity, are calculated on the basis of the rotational-speed pulses and a start-of-injection reference mark. Based upon an instantaneous rotational speed before the metering-in stage, an estimated value is determined, and based upon an instantaneous rotational speed during the metering-in stage, a control value is determined. The estimated value is compared to the control value and, if need be, the estimated value is adjusted.

20 Claims, 4 Drawing Sheets

FUEL INJECTION SYSTEM FOR AN INTERNAL-COMBUSTION ENGINE

FIELD OF THE INVENTION

The present invention relates to a fuel injection system for an internal-combustion engine and in particular to a fuel injection system for a solenoid-valve-controlled fuel pump for a diesel internal-combustion engine.

BACKGROUND OF THE INVENTION

German Patent Application No. 35 40 8 11 describes a fuel injection system for controlling a solenoid-valve-controlled fuel pump for a diesel internal-combustion engine. The system comprises a pump piston which moves in a pump chamber and is driven by the camshaft. The pump piston pressurizes the fuel in the pump chamber. The fuel is then pumped to the cylinder of the internal-combustion engine via a fuel line.

A solenoid valve is positioned between a fuel supply tank and the pump chamber. An electronic control unit delivers control pulses to the solenoid valve. The solenoid valve opens and closes in response to these control pulses. In response to the position of the solenoid valve, the pump piston pumps fuel into the combustion chamber of the internal-combustion engine.

The trigger times of the control pulses determine the start and end of fuel injection, and also, therefore, the fuel quantity to be injected. After a pulse gear on the crankshaft generates a synchronous pulse, a counter is started which counts the pulses on an incremental gear located on the camshaft. As a function of the prevailing motor speed and other parameters, the control element controls the start and end of the injection process. To optimally operate the internal-combustion engine under variable operating conditions, it is necessary to determine the start of injection and the injection quantity as precisely as possible as a function of engine-specific data and existing operating conditions. Because the motor speed is not constant, actual conditions, and in particular, delay times and rotational irregularities of the engine, must be considered when determining the trigger times for the solenoid valve.

In order to obtain the desired accuracy in calculating the trigger times, the angular velocity of the camshaft must be known. The angle covered during a constant time, and thus also the quantity of fuel injected, depend upon the instantaneous angular velocity. An irregular angular velocity, as well as the torsional and driving rigidity of the camshaft, may result in calculation errors. At a constant cam (lift) speed, the injected fuel quantity is proportional to the angle which the camshaft covers during the trigger time, and is independent of the start of injection. In reality, however, the instantaneous rotational speed of the camshaft, and thus also the cam speed, are not constant. This leads to errors in determining the injected fuel quantity.

These errors depend upon the changes in cam speed and rotational speed, which are not considered in the calculation, or on compressional waves and manufacturing tolerances. Known injection systems can consider these influences only conditionally, because they are based on the form of a non-automatic control, and not on the form of an automatic control.

SUMMARY OF THE INVENTION

The method and apparatus of the present invention makes it possible to approximate the correct fuel-injection quantity by checking the camshaft rotational speed values step-by-step. Following a metering-in stage, the apparatus monitors whether the prediction made for the instantaneous rotational speed used for the measuring distance conforms with the actual rotational speed during the metering-in stage. For this purpose, during the metering-in stage, an additional measuring angle is introduced which detects the actual rotational speed during that stage. This value is available only after the solenoid valve is triggered. When the actual rotational speed during the metering-in stage does not conform with the prediction made for the rotational speed for the quantity calculation, the subsequent predictions are corrected step-by-step until there is conformity.

To determine the solenoid-valve trigger times for the start and end of fuel injection, and thus also for the quantity of fuel injected, the instantaneous rotational-speed values are measured in a particularly advantageous way from a pulse transmitter at the camshaft. It is particularly advantageous to measure the rotational-speed pulses in the compression cycle of the engine over a small angle, since in this range, the instantaneous angular velocity decreases at a known rate, and, therefore, can be calculated. No internal moments of rotation from preceding combustion activity in other cylinders, which would give rise to a disturbing rotational irregularity, occur in the compression cycle.

Preferably, an additional check-measurement angle is measured at the camshaft or at a gear wheel connected to the camshaft. The check-measurement angle is selected to correspond to the angular position during the metering-in stage. During that stage, the predicted value is compared to the actual value, and a step-by-step readjustment is made. The tooth clearance of a gear wheel can be used to stipulate a measuring angle. Preferably, the measuring angle of the actual measuring distance and the check-measurement angle can be measured at a single-pulse gear. It is advantageous for each cylinder of the engine to use only one touch as a reference mark on the pulse gear. When a U-shaped, two-pole transmitter is used, the measuring distance for all of the cylinders is the same, and quantitative errors due to manufacturing tolerances of the pulse gear can be avoided.

If both measuring angle, i.e., the measuring angle of the actual measuring distance and the check-measurement angle, are selected to be equal in size and are arranged in a similarly-sized clearance space, then this clearance space constitutes a third measuring angle. It is particularly advantageous for the measuring angle to be configured to detect only the average rotational speed. Thus, the mean value is acquired without delay. This measured value is also well suited for calculating the start of injection, since at this point, the angular velocities of the camshaft and of the crankshaft, which are important for the start of injection, are in phase.

DETAILED DESCRIPTION OF THE INVENTION

Figure 1:
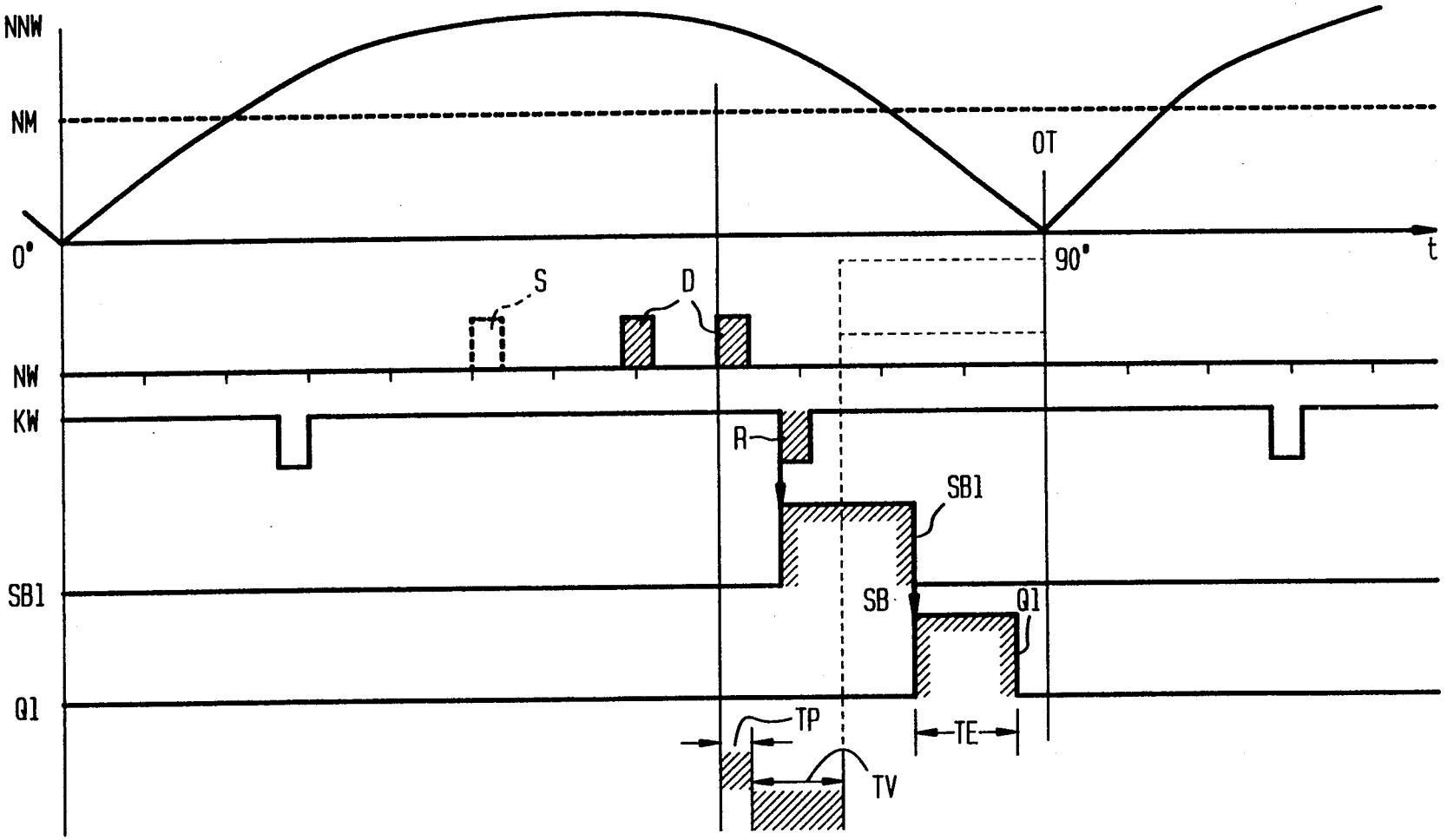
FIG. 1 shows a pulse diagram of the angular velocity of the camshaft as a function of time.

The diagram depicted in FIG. 1 shows the angular velocity NNW of the camshaft of a 4-cylinder engine as a function of time. As shown, at time OT, i.e., at 90°, the angular velocity is at a minimum.

Control pulses are also shown on the same reference axis. The pulses are generated by a pulse transmitter connected to the camshaft NW. The time interval between the two pulses (D) depicted serves as a measuring distance for the instantaneous rotational speed N. FIG. 1 shows only the two most important pulses which define the measuring distance. Other possible pulses are only shown in phantom.

A pulse transmitter connected to the crankshaft KW generates the pulses identified by KW. Immediately following these pulses, which are used to determine the instantaneous rotational speed, the pulse R appears. The pulse R is a start-of-injection reference mark, with which the start of fuel injection is initiated with time delay. The time delay, and thus the actual start of injection SB, are defined by an SB pulse, which is calculated based upon the current operating situation and as a function of engine-specific data.

At the end of the start-of-injection pulse SBI, the quantity pulse QI is generated, which determines the injection quantity Q. The injection quantity Q is dependent upon the injection period TE. The temporal allocation of the rotational-speed pulse D and of the start-of-injection reference mark R must be selected in a way that assures a timely determination of the injection quantity and of the start of injection, in spite of the required program execution time TP of the computer and of the time displacement TV, which occurs as a result of the elasticity between the crankshaft and the camshaft. The start of injection SB occurs within about 5° before time OT.

The trigger times for the solenoid valve which establish the start of injection and the injection quantity are determined separately, preferably from the instantaneous rotational speed N and from engine-specific performance data. In the preferred embodiment, the instantaneous rotational speed is measured at the camshaft NW. The start-of-injection reference mark R is generated by means of a pulse transmitter located on the crankshaft KW. In principle, a mutual pulse generator can also be used to determine the instantaneous rotational speed and as a reference mark for the start of injection. Such a pulse generator can essentially comprise a gear wheel, which is connected to the camshaft or to the crankshaft, and whose teeth generate pulses in a sensing device. Preferably, the measuring distance is assigned to the corresponding solenoid valve by means of a camshaft-specific reference pulse, also described as a synchronization mark S. Synchronization marks, which serve as start-of-injection marks, can be applied to the gear wheel by arranging the teeth somewhat asymmetrically, by adding teeth to gaps, or by omitting teeth.

Figure 2:
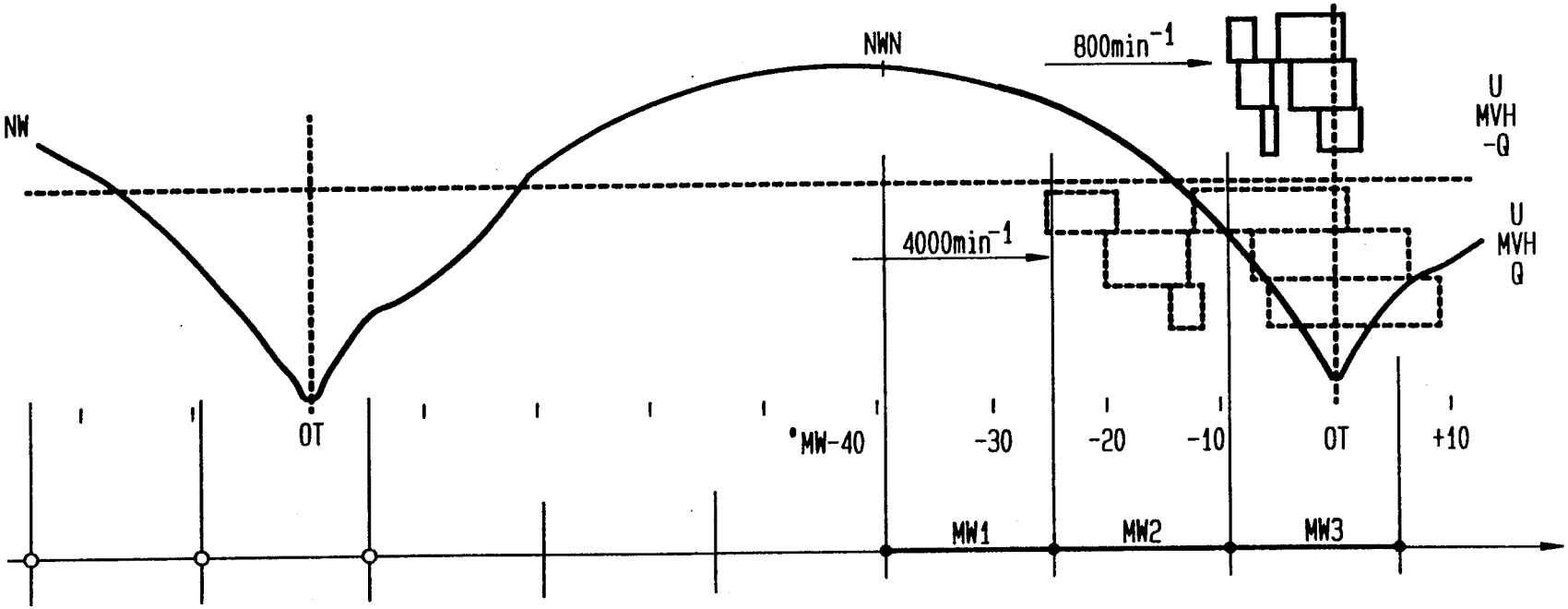
FIG. 2 shows several measuring angles relative to the angular velocity of the camshaft.

In the diagram in FIG. 2, the arrangement of three measuring angles MW1, MW2, and MW3 is sketched as a function of the camshaft angle. Furthermore, the position of the single pulses is plotted as a function of the camshaft angle.

The injected fuel quantity depends on the lift of the cam, which continues over the time the solenoid valve is open. The lift of the cam, in turn, depends on the camshaft rotational speed NWN during the metering-in stage. At least two measuring angles are provided. It is particularly advantageous for these measuring angles to be of the same length. The measuring angle MW1 is situated at the beginning of the compression cycle, where there are no changes in momentum caused by other cylinders. Therefore, from the instantaneous rotational speed at this instant, the rotational speed during the metering-in stage can be inferred. The trigger times are calculated based on this estimated value for the instantaneous rotational speed. The actual instantaneous rotational speed during the metering-in stage is then determined by means of the check-measurement angle MW3. In this manner, the system determines the various rotational irregularities which exist between particular internal-combustion engines and a reference internal-combustion engine.

A particularly advantageous modification of the present invention occurs when the angle between the measuring angles MW1 and MW3 is defined as an average measuring angle MW2. The measuring angle MW2 should be selected so that the rotational-speed value acquired by means of the measuring angle MW2 corresponds to the mean value over several cylinders In this manner, the mean value of the rotational speed is available immediately, and not only after a time delay. Therefore, variables that are calculated on the basis of the average rotational speed are available relatively early.

It is particularly advantageous to provide on the pulse gear teeth between the teeth which are used to generate the measuring angles MW1, MW2 and MW3. Because all of the teeth, and thus all of the pulses, have the said clearance, the signal analysis is simplified. By synchronously marking and counting the pulses, the measuring angles MW can be recognized and differentiated. A further improvement is to increase the number of teeth which will result in a more exact determination of the instantaneous rotational-speed values.

When the average rotational speed is determined by means of the measuring angle MW2, the average rotational speed is available immediately, and not only after a time delay. At lower rotational speeds, the value can even be applied in place of the measuring angle MW1.

In addition, the drive voltage U of the solenoid valve, the solenoid valve lift MVH, and the injected fuel quantity QK are plotted in the pulse diagram for two rotational speeds. At low rotational speeds, e.g., at 800 r.p.m., the metering-in stage essentially takes place in the measuring angle MW3. This applies both to the preliminary as well as to the main injection. At intermediate rotational speeds, the preliminary injection takes place during the measuring angle MW2, and the main injection during the measuring angle MW3. At high rotational speeds, e.g., at 4000 r.p.m., the trigger times may be present before the measuring angle MW1 ends. In this case, the measuring angle MW3 or the measuring angle MW2 of the preceding cylinder is taken into consideration when the trigger times for the preliminary injection are calculated.

As a result of manufacturing tolerances of the pulse gear, the clearances are uneven and, therefore, cause quantitative errors. Such errors are avoided when there is only one tooth for each cylinder or for each measuring angle on the pulse gear, and when the transmitter has a U-shaped design with two poles. This transmitter generates two pulses per tooth in the evaluation circuit, and consequently generates a measuring angle. By means of these two poles, the same measuring distance is set-up for all measuring angles and all cylinders.

Figure 3:
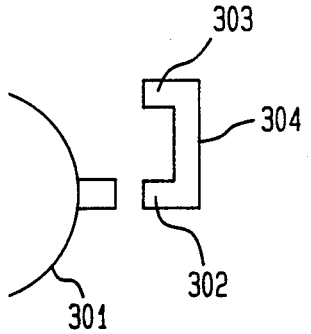
FIG. 3 shows a sensor according to the present invention.

Such a transmitter is depicted in FIG. 3. The pulse gear with one gear is depicted as 301. The first pole 302 of the transmitter is connected to the second pole 303 of the transmitter via the line 304 to the evaluation circuit.

Normally, the instantaneous rotational speed is determined in the first measuring angle MW1. The values vary very little. Therefore, the mean value of the rotational speed is able to be calculated from these instantaneous values through continuous averaging.

Quantitative errors resulting from solenoid valve turn-on times can be eliminated by determining the instant that the solenoid valve closes and the instant that the solenoid valve opens. The difference between the triggering of the solenoid valve and the actual actuation of the solenoid valve, i.e., the switching time of the solenoid valve, is determined. Based on these switching times, the solenoid valve trigger times are corrected or adjusted accordingly. The same also applies to the turn-off time for the solenoid valve. This result is more accurate determinations. The correction values are stored in a storage device. In case there is a failure or malfunction in the determination of the solenoid valve switching times, the stored correction values are utilized.

In an ideal system, there is a fixed relationship between the camshaft angle and the crankshaft angle. In practice, however, this is not the case. Thus, by elongating the connection between the crankshaft and the camshaft, different relationships result between the two shafts. By determining the clearance between a fixed angular pulse on the camshaft and the start-of-injection reference mark R of the crankshaft, the elongation between the pulse gears on the crankshaft and the camshaft can be determined. From the above clearance, a correction signal is obtained, with which the elongation is corrected. Thus, the influence of the elongation may be compensated for. Measuring times that had been altered by the elongation can be corrected. Furthermore, in case of failure of the crankshaft transmitter, a more accurate replacement value can be used for the start-of-injection reference mark R. Also, starting from a certain elongation size, it is possible to activate a display which indicates a necessary replacement.

In case of failure of the crankshaft transmitter, which normally detects the average rotational speed and furnishes the start-of-in]ection reference mark R, it is particularly advantageous that this system makes substitute signals available. As described above, the average rotational speed can be determined by evaluating the measuring angle MW1 or the measuring angle MW2. The start-of-injection reference mark R is replaced by the end of the first measuring distance.

Figure 4:
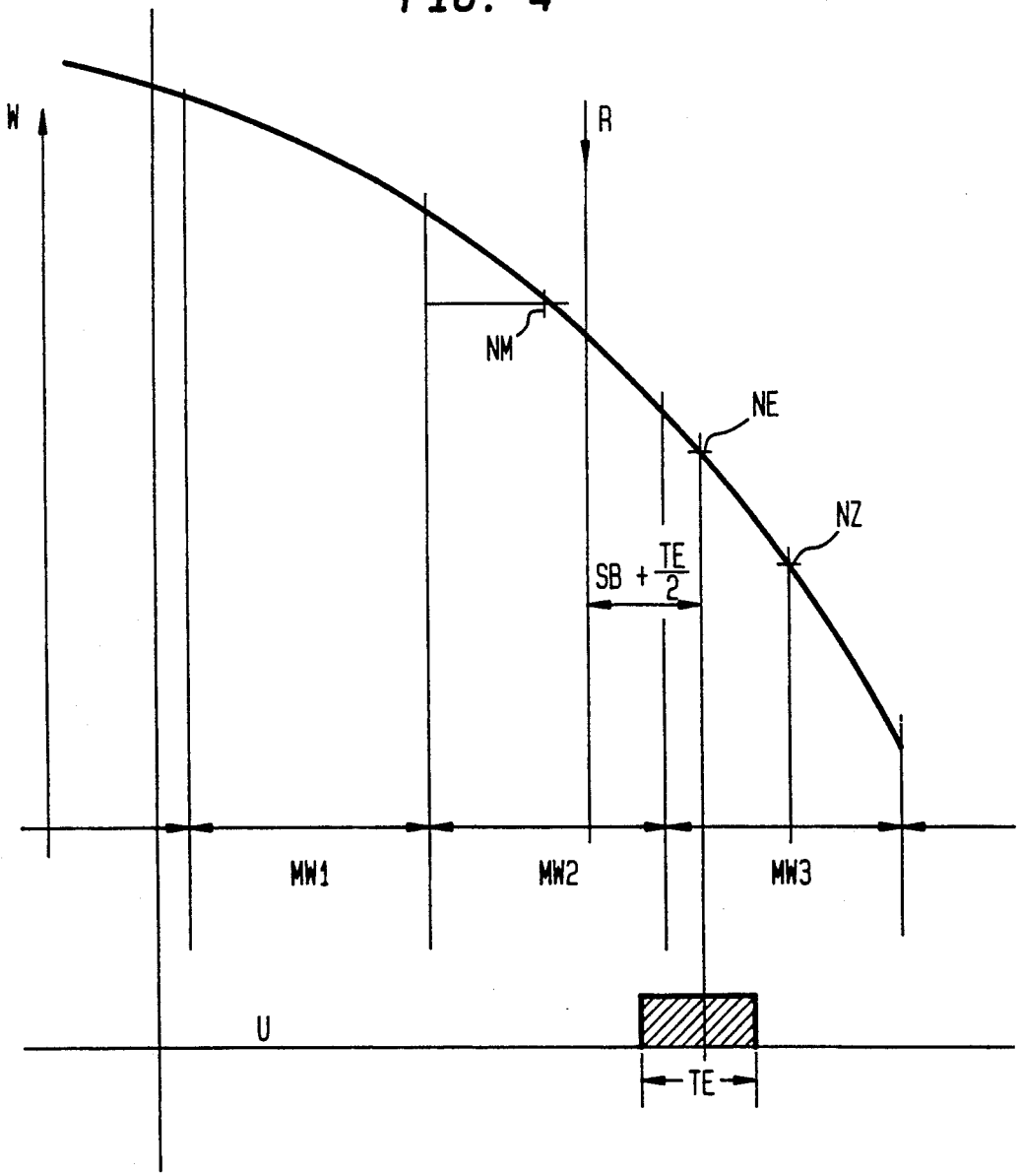
FIG. 4 shows trigger times relative to the angle of the camshaft.

The angular velocity W is depicted in FIG. 4 as a function of the camshaft rotation. The various measuring angles MW1, MW2 and MW3 are again plotted.

The trigger pulse U and the start-of-injection reference mark R of the crankshaft are also shown. The best results for calculating the injection quantity are obtained when the rotational speed NE in the middle of the trigger pulse is taken into consideration.

Therefore, it is particularly advantageous when the middle of the trigger pulse coincides with the middle of the measuring angle MW3. Adjusting the pulse gear in this manner is not possible, however, since the start of injection SB and the injection time TE change continuously as a function of the operating conditions.

Usually, the pulse gear on the camshaft is adjusted in a way which will allow the measuring angle MW2 to be configured to closely correspond with the average rotational speed NM. Therefore, the instantaneous rotational speed NE in the middle of the trigger pulse deviates from the instantaneous rotational speed NZ, which corresponds to the measuring angle MW3. To attain the most accurate possible value for the instantaneous rotational speed during the metering-in stage, the instantaneous rotational speed NE should be known. The camshaft angle, which corresponds to the middle of the trigger pulse, is calculated from the known variables, start of injection SB and injection time TE. Because the start of injection SB is indicated with reference to the crankshaft, the relationship between the crankshaft and the camshaft must remain fixed, or the elongation must be determined and corrected. Based on the instantaneous rotational speed NM in the measuring angle MW2, i.e., the average rotational speed, and the instantaneous rotational speed NZ in the measuring angle MW3, an estimated value is then determined for the instantaneous rotational speed NZ in the middle of the metering pulse by means of an extrapolation. This estimated value is then used in place of the instantaneous rotational speed NZ measured in the measuring angle MW3.

Figure 5:
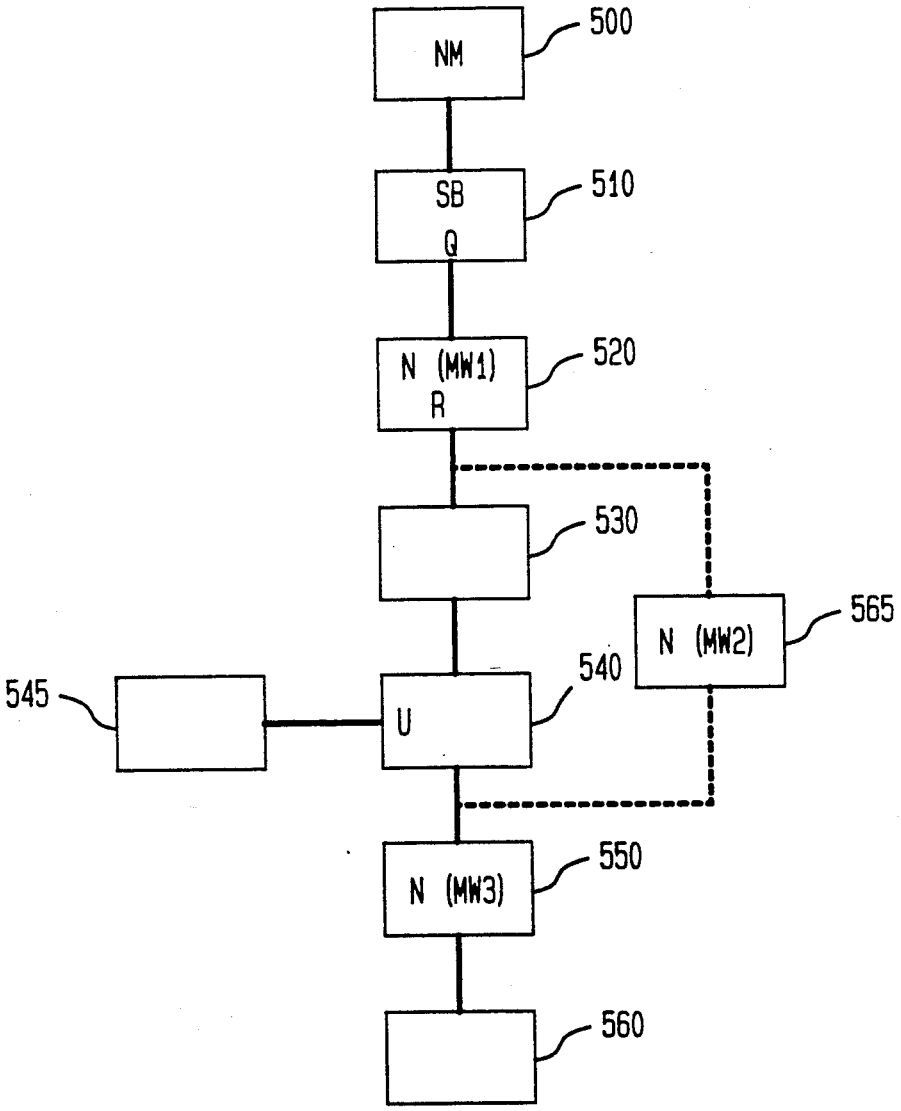
FIG. 5 shows a flow chart of the method according to the present invention.

FIG. 5 contains a flow chart that shows the method according to the present invention. The average rotational speed NM is detected in a first step 500. To do this, pulses from a transmitter on the crankshaft or on the camshaft are evaluated. The average rotational speed is determined over a longer period of time. This period of time extends over several metering-in stages. As a result of this procedure, fluctuations in the average rotational speed can be avoided.

In the following step 510, the desired start of injection SB and the desired fuel quantity to be injected are determined. These values are determined as a function of the average rotational speed and additional operating parameters, such as gas-pedal position. Subsequently, the rotational speed N(MW1) in the measuring angle MW1 and the start-of-injection reference mark R are determined in step 520. In step 530, the rotational speed during the metering-in stage is predicted. By means of the rotational speed N(MW1) and various adaptive parameters, an estimated value for the rotational speed during the metering-in stage is calculated in step 530. By means of a first adaptive parameter A1, a multiplicative adaptation follows, and by means of a second adaptive parameter A2, a cumulative adaptation follows.

In step 540, the trigger times are calculated for the solenoid valve. By detecting the actual opening times and closing times of the solenoid valve, the trigger times can be corrected accordingly. These correction values are calculated in step 545 as a function of the opening and closing times of the solenoid valve for the trigger times.

The start-of-injection pulse, which establishes the exact start of injection, depends on the start-of-injection reference mark. The injection time, and thus the trigger times, which establish the end of injection, depend on the instantaneous rotational speed during the metering-in stage. Therefore, the estimated value of the rotational speed determined by means of prediction is relied upon.

In step 550, the correction value for the rotational speed in the measuring angle MW3 is determined. The correction step 560 follows this. Based upon the comparison between the estimated value of the rotational speed determined by means of prediction and the control value of the rotational speed measured in the measuring angle MW3, the adaptive parameters are modified by a controller in such a way that the two rotational-speed values conform.

The system is designed so that it does not react to short-term deviations. It reacts only to periodic, averaged deviations. The system prevents variations in quantity between particular engines, and creates an automatic control for running smoothness.

Parallel to steps 530 and 540, the rotational speed N(MW2) in the measuring angle MW2 is determined in step 565. This rotational speed corresponds to the average rotational speed NM. The average rotational speed NM is obtained from the rotational speed N(MW2) through an ongoing mean-value determination, in which the same number of prior measured values are always used.

In another embodiment of the present invention, the trigger times are calculated based on the rotational speed corresponding to the measuring angle MW1. The trigger times are then corrected by means of various adaptive parameters, and the estimated value is obtained in this manner. In correction step 560, the trigger instants are then calculated again based upon the rotational speed corresponding to the measuring angle MW3, and the control value is obtained in this manner. The controller then compares the trigger times which were calculated on the basis of the measuring angle MW1 to those which were calculated on the basis of the measuring angle MW3, and corrects the adaptive parameters based upon these comparisons.

In yet another embodiment of the present invention, the trigger times are calculated on the basis of the estimated value for the rotational speed. In correction step 560, the trigger times are calculated again based upon the rotational speed acquired in the measuring angle MW3. The controller then compares the trigger times which were calculated on the basis of the measuring angle MW1 to those which were calculated on the basis of the measuring angle MW3, and corrects the adaptive parameters based upon these comparisons.

I claim:

1. A fuel injection system for an internal-combustion engine, comprising:

means for adjusting the fuel injection quantity and the start of fuel injection;

means for measuring rotational-speed pulses associated with the camshaft and the crankshaft;

a control unit for delivering control pulses to a solenoid valve, the solenoid valve opening and closing based upon trigger times for the control pulses, the trigger times establishing the fuel injection quantity and the start of fuel injection;

means for determining the trigger times based upon the rotational-speed pulses and a start-of-injection reference mark;

means for determining an estimated value based upon an instantaneous rotational speed of the camshaft before a metering-in stage;

means for determining a control value based upon an instantaneous rotational speed during the metering-in stage; and comparison means for comparing the estimated value to the control value, and for adjusting the estimated value to decrease the difference between the estimated value and the control value.

2. The system as recited in claim 1, wherein the estimated value and the control value are of the instantaneous rotational speed.

3. The system as recited in claim 1, wherein the estimated value and the control value are of the trigger times.

4. The system as recited in claim 1, wherein the system measures an instantaneous rotational speed of the camshaft before fuel in]ection in a first measuring angle, and measures the instantaneous rotational speed during the metering-in stage in a third measuring angle.

5. The system as recited in claim 4, wherein the first measuring angle is during a compression cycle of the engine.

6. The system as recited in claim 4, wherein the first measuring angle is formed by a tooth clearance on the camshaft.

7. The system is recited in claim 4, wherein the first measuring angle is formed by a tooth clearance on the crankshaft.

8. The system as recited in claim 4, wherein the third measuring angle is determined by the disposition of the camshaft.

9. The system as recited in claim 4, wherein the third measuring angle is determined at a gear wheel coupled to the camshaft.

10. The system as recited in claim 4, wherein the first measuring angle is equal to the third measuring angle, with both angles being measured at a single pulse gear.

11. The system as recited in claim 4, wherein a pulse gear has a tooth for each cylinder of the engine, the tooth being used as a reference mark that is recognized by a U-shaped, two-pole transmitter.

12. The system as recited in claim 4, wherein a second measuring angle is between the first and third measuring angles, with the second measuring angle conforming with a position of an average rotational speed of the camshaft.

13. The system as recited in claim 12, wherein the first, second, and third measuring angles are equal in size.

14. The system as recited in claim 4, wherein the trigger times are adjusted based upon the actual closing point of the solenoid valve, and are controlled based upon a stored correction value if the closing point cannot be determined.

15. The system as recited in claim 4, wherein the instantaneous rotational-speed value measured during the metering-in stage is adjusted to correspond to the instantaneous rotational-speed value in the middle of a control pulse.

16. The system as recited in claim 12, wherein the system includes a crankshaft transmitter for determining the average rotational speed of the crankshaft and providing a start-of-injection reference mark.

17. The system as recited in claim 16, wherein the average rotational speed is determined from the first measuring angle if the crankshaft transmitter fails.

18. The system as recited in claim 16, wherein the average rotational speed is determined from the second measuring angle if the crankshaft transmitter fails.

19. The system as recited in claim 16, wherein the system evaluates the average rotational speed by evaluating an end of a first measuring distance, and the first and second measuring angles, if the crankshaft transmitter fails.

20. The system as recited in claim 4, wherein elongation between the crankshaft and the camshaft is determined and adjusted.

* * * * *

UNITED STATES PATENT AND TRADEMARK OFFICE

CERTIFICATE OF CORRECTION

PATENT NO. : 5,105,788

DATED : April 21, 1992

INVENTOR(S) : Gerhard Engel

It is certified that error appears in the above-identified patent and that said Letters Patent is hereby corrected as shown below:

Column 2, line 43, change "touch" to --tooth--.

Column 2, line 49, change "angle," to --angles,--.

Column 4, line 29, insert a period after "cylinders".

Column 4, line 39, change "said" to --same--.

Column 5, line 52, change "in]ection" to --injection--.

Signed and Sealed this

Twenty-sixth Day of October, 1993

*Attest:*

Bruce Lehman

BRUCE LEHMAN

*Attesting Officer*

*Commissioner of Patents and Trademarks*